United States Patent [19]

Mengeringhausen

[11] 3,952,402

[45] Apr. 27, 1976

[54] COMPOSITE STRUCTURAL PANEL AND PROCESS OF MAKING

[75] Inventor: Max Mengeringhausen, Wurzburg, Germany

[73] Assignee: Mero AG, Wurzburg, Germany

[22] Filed: Feb. 8, 1974

[21] Appl. No.: 440,762

Related U.S. Application Data

[63] Continuation-in-part of Ser. No. 111,820, Feb. 2, 1971, abandoned.

[52] U.S. Cl. ..... 29/527.1; 52/743; 264/156; 264/249; 264/267

[51] Int. Cl.[2] ..... B22D 11/126

[58] Field of Search ..... 29/155 R, 527.1; 52/743; 264/60, 67, 156, 249, 266, 267, 274

[56] References Cited

UNITED STATES PATENTS

| | | | |
|---|---|---|---|
| 2,601,532 | 6/1952 | Knighton | 264/256 X |
| 2,673,373 | 3/1954 | Heuer | 264/274 X |
| 2,764,887 | 10/1956 | D'Ambly | 264/274 X |
| 2,917,776 | 12/1959 | Dorman et al. | 425/812 |
| 3,100,677 | 8/1963 | Frank et al. | 264/267 X |
| 3,385,015 | 5/1968 | Hadley | 29/155 R X |

FOREIGN PATENTS OR APPLICATIONS

| | | | |
|---|---|---|---|
| 567,930 | 8/1960 | Belgium | |
| 1,038,935 | 8/1966 | United Kingdom | 29/155 R |

*Primary Examiner*—C. W. Lanham
*Assistant Examiner*—V. K. Rising
*Attorney, Agent, or Firm*—Brady, O'Boyle & Gates

[57] ABSTRACT

A structural panel having a thin-walled outer layer of high tensile strength and/or high modulus of elasticity material preformed as a large area trough open at the top and of a depth substantially the thickness of the panel, into which is poured a low tensile strength and/or a low modulus of elasticity material in metered quantities, which is compacted and hardened therein, in such a manner to form a composite with the trough where the trough is an externally disposed reinforcement member for the panel. The trough has a peripheral flange around the open top with accurately positioned apertures therethrough, or accurately positioned apertures through the bottom of the trough near the corners for connecting a plurality of the panels in alignment to external supports. The accurately positioned apertures are formed at the same time the trough is formed. The open top of the trough may be closed by a horizontal stress transmitting cover plate connected to the peripheral flange.

3 Claims, 11 Drawing Figures

INVENTOR
MAX MENGERINGHAUSEN
BY Brady, O'Boyle & Gates
ATTORNEYS

INVENTOR
MAX MENGERINGHAUSEN
BY Brady, O'Boyle & Gates
ATTORNEYS

COMPOSITE STRUCTURAL PANEL AND PROCESS OF MAKING

REFERENCE TO RELATED APPLICATION

This application is a continuation-in-part of application Ser. No. 111,820, filed Feb. 2, 1971, now abandoned.

This invention relates to a process for the production of composite structural panels to be combined with a load-bearing base construction for the purpose of manufacturing, for example, double floors, ceilings, or roofs, the materials employed being a material with a high tensile strength and/or a high modulus of elasticity and a material with a low tensile strength and/or a low modulus of elasticity which is fluid or pourable and can be hardened.

It is conventional to produce shaped articles of concrete with an internal reinforcement of steel rods or steel mats, for example also in the form of flat structural panels, which are predominantly under flexural stress. It is furthermore known to compact such shaped articles by jarring or compressing the concrete prior to the curing thereof, and finally also to heat such articles to accelerate the hardening process. In order to obtain satisfactory properties regarding the strength, it is necessary to embed the steel reinforcement as uniformly as possible in the cross section of the structural panel. However, this presents considerable difficulties, particularly in case of large-area structural panels of a relatively minor thickness, since the steel reinforcement can easily shift during the compacting of the concrete and for this reason the use of special supports are required. Besides, when a steel reinforcement is embedded in the concrete, the concrete cross section disposed on the tension side is not utilized statically.

Furthermore, the conventionally constructed building panels of concrete are relatively thick, due to the reinforcement embedded therein, and thus are correspondingly heavy, so that they are unsuitable or at least uneconomical for many purposes. Besides, these conventionally reinforced concrete building panels cannot be placed solely at their corners, since the reinforcement ordinarily does not reach into the corners, and thus the load stresses cannot be directly transmitted into the reinforcement, either.

Another disadvantage of the conventional processes for the manufacture of concrete building panels resides in that the dimensional accuracy obtainable in the finished products is insufficient for many purposes. Furthermore, for example in case of three-dimensional frameworks and double floors for electronic computers, control boards, and similar instances, the structural panels must be designed, as roof or floor elements, in such a manner that they are capable of sustaining flexural stresses as well as tensile and compressive forces in the panel plane proper, in order to attain the required composite effect between the structural panels and the rod elements of the three-dimensional framework or of the foundation of double floors. However, an additional prerequisite for obtaining this composite effect is a high dimensional accuracy of the building panels, as customary in metallic components (for example, on the order of magnitude of ± 0.2 mm.). However, on the other hand, the economical manufacture of such structural panels in large quantities must not be impaired by the condition of a relatively high dimensional accuracy, since otherwise the large-scale use thereof would be doubtful. Consequently, the manufacturing expenses for the individual building panel are to be maintained as low as possible.

In many applications (for example in the use of the structural panels in work scaffolding structures or airplane servicing platforms), it is not only necessary for the building panels to be readily combinable with mass-produced components of steel or light metal (in order to obtain, inter alia, the possibility of assembling and disassembling the structure many times), but the building panels are also to exhibit as low a weight as possible and are to be rugged during transport, so that the edges of the building panels are not readily damaged, and the panels themselves withstand heavy impacts. The conventionally manufactured prefabricated building panels for building construction, or the so-called sandwich elements produced with the use of concrete do not meet the above-mentioned requirements in any way whatever. The composite building panels produced in accordance with known manufacturing methods and made of materials other than reinforced concrete, for example plastics, or fibrous substances including organic fibrous materials bonded by a synthetic resin do not satisfy the aforementioned demands, either.

Accordingly, this invention is based on the problem of providing an economical process for the production of composite structural panels, avoiding the difficulties encountered in the conventional embedding of reinforcements and making it possible to produce large-area building panels of a very high dimensional accuracy exhibiting, as compared to known building panels, additionally improved strength properties at a minor thickness, which panels, due to their high accuracy with respect to size, can readily be combined with standard building components of steel and light metal for the purpose of producing a great variety of composite constructions.

In accordance with the invention, this object is attained by preforming the material of high tensile strength and/or high modulus of elasticity as a thin-walled, large-sized trough open at the top; thereafter introducing the fluid or pourable material of low tensile strength and/or low modulus of elasticity into the trough in metered quantities; and subsequently compacting and hardening the latter material within the trough in such a manner that it forms a composite with the trough, and the trough becomes an externally disposed reinforcement. The "metered" introduction of the material is understood to mean that the material is fed into the trough in predetermined amounts, wherein the theoretically required quantity can also be exceeded ("overdose"), or a smaller amount can be employed ("underdose").

The externally positioned reinforcement eliminates the supports for the internal reinforcement employed in the conventional processes. Due to the fact that the outside reinforcement is press-molded, namely suitably together with the required anchoring means for the supporting foundation, the dimensional accuracy necessary for many purposes wherein the composite structural panel is utilized, is ensured in a simple manner so that it can easily be combined with standard structural elements of steel and light metal for the production of a composite construction enabling an interplay of the forces between the supporting base construction (skeleton of steel or light metal) and the composite building panels. In other words, a composite structural panel manufactured in accordance with the process of this invention exhibits exact external dimensions and accurately fixed anchoring means for the supporting foundation. Advantageously, the fluid or pourable material of low tensile strength and low modulus of elasticity is, furthermore, compacted and hardened in the trough, thus obtaining a composite effect between the two elements which can be additionally enhanced by the provision of conventional anchoring means in the trough. Furthermore, the anchoring elements for the two above-indicated purposes are advantageously formed during the shaping of the trough. A composite structural panel manufactured in accordance with the proce s of this invention additionally exhibits high strength values at a relatively minor thickness and a low weight. The fluid or pourable material can consist, depending on the purpose for which the structural panel is employed, for example, of concrete, mineral substances with a cement binder (including aerated cement), plaster of Paris, or plaster-bound mineral substances, synthetic resin compositions, organic fibrous materials with synthetic resin binders, synthetic resin compositions with fillers embedded therein, such as, for example, bloated concrete, or perlites, wood concrete of wood fibers and cement, asbestos cement, or the like. Also the combinations of materials which can be processed into so-called artificial stones can be employed for this purpose. The trough can be made of steel, galvanized steel sheet, or steel plate with a rust prevention coating on both sides and/or with a plastic coating on the visible side, light-metal alloys, press-moldable plastics of a high tensile strength, such as, for example, glass-fiber-reinforced synthetic resin, etc.

In a further embodiment of the invention, the flowable or pourable material can at first be introduced into the tub in a small excess and, after the compacting step, the excess material can be stripped off or squeezed off in order to obtain an accurate total thickness. By the last-mentioned process step, a compression of the material and a smoothing of the surface thereof are additionally attained.

Furthermore, the fluid or pourable material can be introduced into the trough in a small overdose, and the exact quantitative dimensioning can be effected during the compacting operation by squeezing excess material through apertures in the trough. Advantageously, the openings at the incorporated anchoring means are employed for this purpose.

The fluid or pourable material can also be fed into the tub in an amount which is slightly underdosed, and the exact dimensioning and compacting can be effected by the formation of additional cavities in the material.

Another feature of the present invention resides in that the fluid or pourable material is precompressed in the trough and that, subsequently, conventional anchoring apertures for the material are impressed in the trough and the impressing tools are introduced through these apertures in order to compress the material; the tools are extended into the material and retracted after the compacting process is terminated. This feature provides the advantage that the pressure tools fulfill two functions in immediate succession, by first impressing the anchoring apertures into the trough and thereafter entering the filler material in order to compress same to the desired degree.

Advantageously, the compression and/or hardening of the fluid or pourable material in the trough is conducted with a simultaneous supply of heat. This shortens the total manufacturing time for the structural panel substantially.

During the compression of the flowable or pourable material, a compensating layer of a small thickness can be produced from a synthetic resin or the like which can be expanded and cured by the application of pressure or heat. This compensating layer provides an additional possibility for an exact determination of the height of the panel.

The invention will be explained in greater detail below with reference to the drawings showing several embodiments, wherein.

The process for the production of the composite building panels can be executed with various materials. However, for the sake of simplicity, the invention will be described hereinafter with the use of concrete as the material of low tensile strength and low modulus of elasticity, and steel as the material of high tensile strength and high modulus of elasticity.

The flat trough 1 is preformed from a thin-walled steel plate, for example by press-molding, during which procedure anchoring means in the form of openings 2 with inwardly drawn edges for the concrete 3 are simultaneously impressed. Furthermore, in the same operating step, anchoring elements are molded into the trough, not shown in FIGS. 1 and 2, which are required for attaching the composite panel to a supporting base construction, which latter is likewise not shown.

Figure 1:
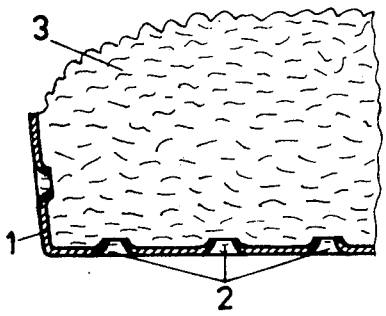
FIGS. 1 and 2 are fragmentary sectional views of two different stages of one embodiment of the process according to the present invention.
Figure 2:
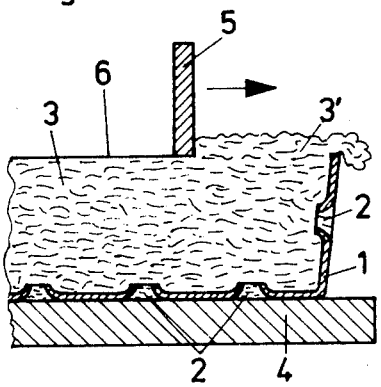

According to FIG. 1, concrete 3 is introduced into the trough 1 at a slight excess. Thereafter, the trough 1 is placed on a jarring table 4 on which the compacting of the concrete 3 takes place. Any excess concrete 3' is removed, according to FIG. 2, by means of a wiper 5 in order to obtain a smooth and additionally compacted concrete surface 6. In place of the wiper 5 illustrated in FIG. 2, it is also possible to employ a roller-type scraper (not shown) which is of advantage especially in the production of elongated panels and makes it likewise possible to obtain an additional compacting and smoothing of the concrete surface. After the concrete has been compressed and hardened, it forms a composite with the trough 1, and the latter becomes an external reinforcement ensuring the desired high dimensional accuracy of the finished composite building panel. The concrete which has entered into the openings 2 forms conical anchoring elements advantageously enhancing the composite effect.

Figure 3:
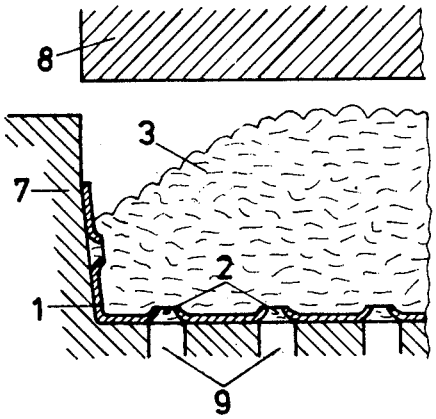
FIGS. 3 and 4 are fragmentary sectional views of two stages of another embodiment of the process of this invention.
Figure 4:
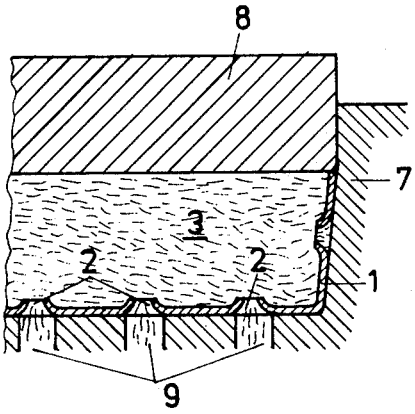

In the embodiment according to FIGS. 3 and 4, the trough 1 is placed into a compression mold 7 of an appropriate cross section, and thereafter the concrete 3 is again introduced into the trough 1 with a minor overdose. By lowering the press ram 8, the concrete 3 is compressed; simultaneously, during the compression step, any excess concrete is pressed out through the openings 2 and through apertures 9 aligned with the latter in the bottom of the compression mold 7. The exact quantitative metering of the concrete is thus effected, in this embodiment, during the compacting thereof, so that the originally fed amount is not critical.

It is also possible to fill the concrete 3 into the trough 1 at a slightly reduced dosage and obtain the exact dimensioning and compression of the concrete by the formation of cavities (not shown) in the concrete. Such cavities can be produced, for example, by the insertion of dies, which are not shown, through the apertures 9 and 2 into the concrete 3, after the press ram 8 has been lowered into the position shown in FIG. 4.

Figure 5:
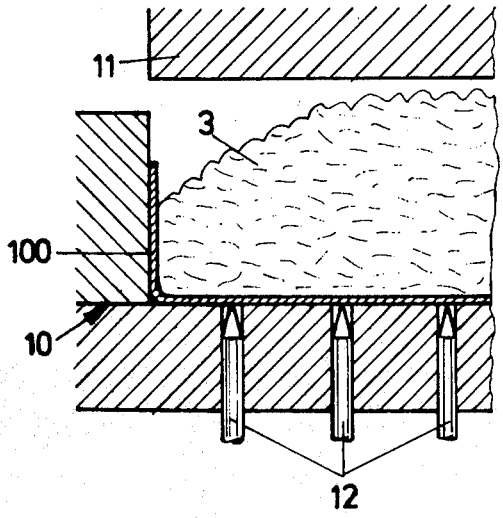
FIGS. 5 and 6 are fragmentary sectional views showing several stages of a further embodiment of the process of the present invention.
Figure 6:
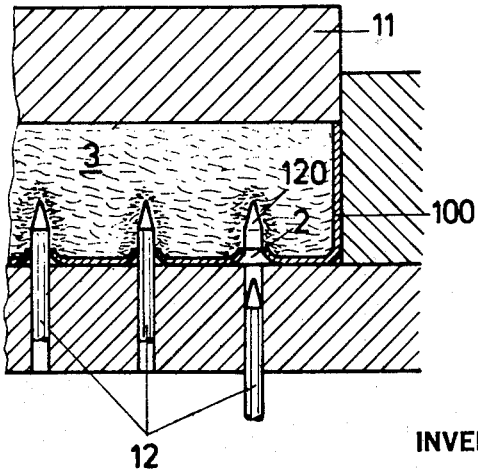

According to the embodiment of FIGS. 5 and 6, the press-molded trough 100, without any openings 2, is placed into a compression mold 10, and the concrete 3 is thereafter introduced at a slight underdose. It is to be noted that the anchoring elements (not shown) for the supporting foundation (not shown) are already formed during the press-molding of the trough. Then, the press ram 11 is lowered into the position shown in FIG. 6, during which step the conrete 3 is precompressed. Thereupon, with the aid of pressure tools 12 guided in the bottom portion of the press mold 10, the openings 2 are impressed into the bottom of the trough 1, and the impressing tools 12 are thereafter introduced into the concrete 3 to finally compact the latter, by being passed through these openings 2, and are retracted after the compacting step. During this procedure, the above-mentioned cavities 120 are formed in the concrete 3.

Figure 7:
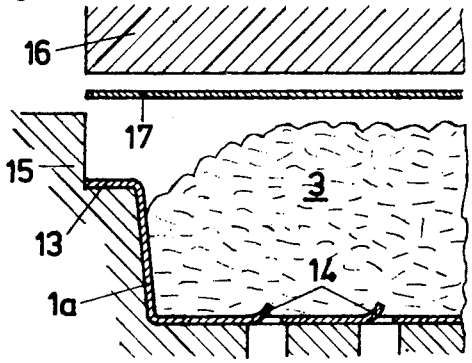
FIGS. 7 and 8 show fragmentary sectional views of two process stages similar to those of FIGS. 3 and 4, but in conjunction with a modified trough-shaped reinforcement.
Figure 8:
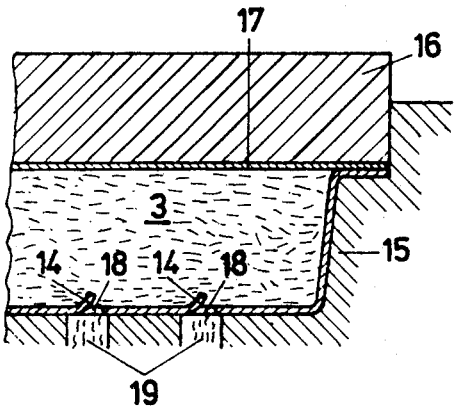

In the embodiment according to FIGS. 7 and 8, a press-molded trough 1*a* is employed, provided with a peripheral flange 13 and inwardly pressed anchoring tongues 14 for the concrete 3. The trough 1*a* is placed, in this embodiment, into a correspondingly shaped compression mold 15, and the concrete 3 is introduced at a minor excess. The compression of the concrete is accomplished by lowering the press ram 16 into the position shown in FIG. 8, with the interposition of a cover plate 17. Any excess concrete is pressed out during the compacting step through the apertures 18 produced during the impressing of the anchoring tongues 14, as well as through openings 19, aligned therewith, in the bottom of the press mold 15, as shown in FIG. 8. The cover panel 17 can be joined to the peripheral flange 13 of the trough 1*a* in any desired conventional manner, in order to finish the composite structural panel. Depending on the material employed, this cover panel can serve merely for improving the appearance of the concrete surface, or for forming a compensating layer, or for taking over additional static functions. For example, in case the cover plate consists of a planar steel plate, the composite building panel is closed off on all sides. In this case, the cover panel is additionally capable of transmitting horizontal stresses in the plane of the panel or in parallel to the panel plane.

The anchoring elements for the supporting foundation, simultaneously formed during the press-molding of the trough 1*a*, are not illustrated in FIGS. 7 and 8.

Instead of conducting the above process steps for the accurate measuring of the concrete 3 and thus also for the exact dimensioning of the height of the finished composite building panel, it is possible, in case of an underdosed concrete filling, to bond a compensating layer of a minor thickness to one side of the concrete during the precompression step, which layer is expanded and hardened under the effect of pressure or heat. Consequently, in this embodiment, the exact height of the composite structural panel is determined by the compensating layer, the latter preferably being flush with a peripheral flange or with the upper peripheral edge of the trough.

Figure 9:
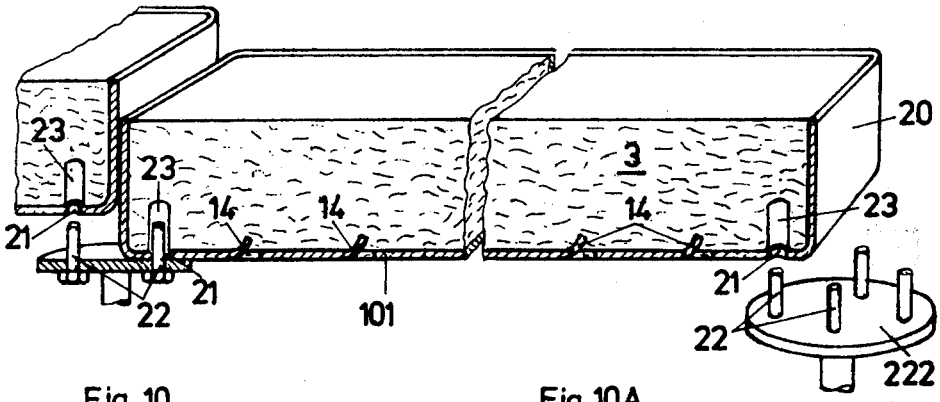
FIG. 9 is a sectional view of a composite structural panel produced in accordance with the process of this invention as a floor element for a double floor.

FIG. 9 shows an embodiment of the composite building panels produced in accordance with the process of the present invention as floor elements for a double floor. For this purpose, the composite building panels must exhibit exact external dimensions with a tolerance of about $\pm 0.2$ mm., which is attained by the peripheral edge 20 drawn exactly vertically upwardly during the compression molding of the trough 101. At the same time, the anchoring openings 21 are incorporated at exactly fixed points during the press-molding of the trough 101. During the assembly of the double floor, the fitting pins 22 of the base supports 222 engage these openings 21. An exact fixation of the composite structural panel is automatically effected during this process, due to the fact that the openings in the trough are incorporated, according to this process, in a dimensionally accurate manner in an economical manufacturing step. During the compacting of the concrete 3, cavities 23 are formed in the concrete in a conventional fashion, in order to provide space for the pins 22 of the base supports. Anchoring tongues 14 improve the composite effect between the trough 101 and the concrete 3.

Figure 10:
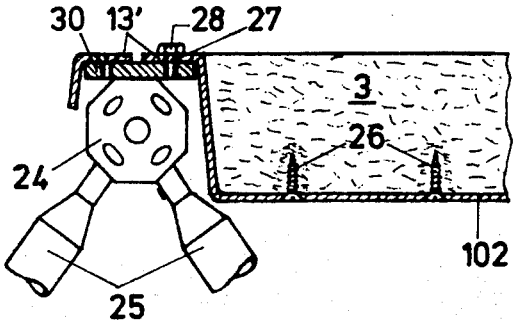
FIGS. 10 and 10A are fragmentary sectional views of a composite building panel manufactured according to this process as a cover panel for a three-dimensional framework.
Figure 10A:
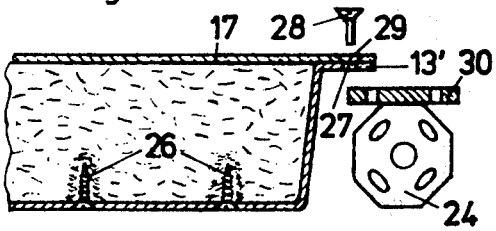

FIGS. 10 and 10A illustrate a further example for the use of a composite structural panel manufactured according to the process of this invention as a cover panel of a three-dimensional framework consisting of junction pieces 24 and rods 25. This composite building panel again contains a trough 102 with anchoring screws 26 inserted during the press-molding step, for the concrete 3, and with a peripheral flange 13′ wherein, likewise during the press-molding step, anchoring apertures 27 for fastening screws or pins are provided at exactly fixed points. According to FIG. 10A, the composite building plate is additionally provided with a cover panel 17 analogously to FIG. 8, exhibiting openings 29, aligned with apertures 27, for the passage of the screws 28. During the assembly of the composite panels, the screws 28 are threadedly inserted in supporting plates 30 at the junction pieces 24. In this embodiment of the composite structural panel, it is unnecessary for the outer rim of the peripheral flange 13′ to be true to size exactly, since the composite effect between the panels and the supporting foundation is achieved by the accurately fixed screws 28. With the aid of the screws and the apertures 27, precisely arranged in accordance with the present process, it is not only possible in this case to effect an exact fixation of the composite structural panel within the three-dimensional framework, but it also becomes possible to transmit the forces effective on the building panel in the vertical direction into the three-dimensional framework and furthermore to transmit horizontal tensile or compressive forces (in the plane of the panel or in parallel to this panel plane) either from the junction pieces to the building panel, or from the building panel to the junction pieces. It is to be emphasized that the process of the present invention makes it possible to manufacture, in an economical manner, composite structural panels ensuring, during their use, compound effects between the panels and the three-dimensional frameworks.

It can be seen from the above embodiments that the accurate arrangement of the anchoring openings in the trough is of great importance, and that, in some applications, for example in connection with double floors, also the external dimensions of the finished composite structural panel must be maintained within narrow limits. Due to the preliminary shaping step, for example the press-molding of the trough forming simultaneously the externally disposed reinforcement for the finished composite building panel, the above requirements can readily be fulfilled.

The amount of material introduced into the trough is determined by the type of panel being mass-produced and the nature or property of the pourable material being used. Thus, if anhydrite, concrete or gypsum is used as the pourable material, an approximate overdose is introduced into the trough, but if plastic material is used as the pourable material, an approximate underdose is introduced into the trough. Therefore, in the mass production of gypsum or concrete panels, each trough will have an overdose of pourable material introduced therein and the excess will be squeezed out as shown in FIGS. 1 to 4. If the panels are being made from plastic, each trough will have an underdose of material introduced therein and the desired volume is obtained by forming cavities in the panel as shown in FIGS. 5 and 6, wherein impressing tools are extended into the material and then retracted therefrom while the pourable material is being hardened, or by bonding a synthetic resin on the surface of the plastic material and expanding the layer.

I claim:

1. A process for the production of a self-supporting composite structural panel comprising, a. preforming a thin-walled large area, open top metallic trough having a depth substantially the thickness of the panel to be produced and having openings in the bottom of the trough;

b. introducing a plastic-like, hardenable, pourable material into the trough in an amount slightly less than the volume of the trough cavity;

c. extending impressing tools into the material through the openings in the bottom of the trough and then retracting the impressing tools therefrom while the pourable material is being hardened, to thereby form cavities in the pourable material to obtain the desired volume; and d. allowing the pourable material to harden within the trough in such a manner that it forms a composite with the trough, whereby the trough becomes an externally disposed reinforcement for the panel.

2. A process for the production of a self-supporting composite structural panel comprising, a. preforming a thin-walled large area, open top, metallic trough having a depth substantially the thickness of the panel to be produced and having openings in the bottom of the trough;

b. depositing the trough in a mold having apertures in the bottom thereof;

c. aligning the openings in the bottom of the trough with the apertures in the bottom of the mold;

d. introducing a plastic-like, hardenable, pourable material into the trough in an amount slightly less than the volume of the trough cavity;

e. extending impressing tools into the material through the apertures in the bottom of the mold and openings in the bottom of the trough;

f. retracting the impressing tools from the material while the pourable material is being hardened to thereby form cavities in the pourable material to obtain the desired volume; and g. allowing the pourable material to harden within the trough in such a manner that it forms a composite with the trough, whereby the trough becomes an externally disposed reinforcement for the panel.

3. A process for the production of a self-supporting composite structural panel comprising, a. preforming a thin-walled large area, open top, metallic trough having a depth substantially the thickness of the panel to be produced and having openings in the bottom of the trough;

b. depositing the trough in a mold having apertures in the bottom thereof;

c. aligning the openings in the bottom of the trough with the apertures in the bottom of the mold;

d. introducing a plastic-like, hardenable, pourable material into the trough in a slight excess of the volume of the trough cavity;

e. compressing the pourable material in the trough to squeeze out excess material through the openings in the bottom of the trough and the apertures in the bottom of the mold to thereby obtain the desired volume; and f. applying heat to the pourable material to harden the pourable material within the trough in such a manner that it forms a composite with the trough, whereby the trough becomes an externally disposed reinforcement for the panel.

* * * * *

UNITED STATES PATENT OFFICE

CERTIFICATE OF CORRECTION

Patent No. 3,952,402 Dated April 27, 1976

Inventor(s) MAX MENGERINGHAUSEN

It is certified that error appears in the above-identified patent and that said Letters Patent are hereby corrected as shown below:

In the heading, in the line designated [73] following "Assignee: MERO AG," change "Wurzburg, Germany" to -- Zug, Switzerland--.

Signed and Sealed this

Tenth Day of August 1976

[SEAL]

*Attest:*

RUTH C. MASON
*Attesting Officer*

C. MARSHALL DANN
*Commissioner of Patents and Trademarks*